US010781553B1

(12) United States Patent
Conard

(10) Patent No.: US 10,781,553 B1
(45) Date of Patent: Sep. 22, 2020

(54) METHOD AND APPARATUS FOR CREATING AN IMAGE ON A FABRIC

(71) Applicant: Adam Conard, Denver, CO (US)

(72) Inventor: Adam Conard, Denver, CO (US)

( * ) Notice: Subject to any disclaimer, the term of this patent is extended or adjusted under 35 U.S.C. 154(b) by 0 days.

(21) Appl. No.: 16/431,093

(22) Filed: Jun. 4, 2019

Related U.S. Application Data

(63) Continuation-in-part of application No. 13/972,458, filed on Aug. 21, 2013, now Pat. No. 10,309,055.

(51) Int. Cl.

| | |
|---|---|
| ***D06P 7/00*** | (2006.01) |
| ***B41M 3/00*** | (2006.01) |
| ***A41D 27/08*** | (2006.01) |
| ***A41D 1/06*** | (2006.01) |

(52) U.S. Cl.
CPC ..... *D06P 7/00* (2013.01); *A41D 1/06* (2013.01); *A41D 27/08* (2013.01); *B41M 3/005* (2013.01); *A41D 2600/10* (2013.01)

(58) Field of Classification Search
CPC ..... D06P 7/00; B41M 3/005; A41D 27/08; A41D 1/06; A41D 2600/10
See application file for complete search history.

(56) References Cited

U.S. PATENT DOCUMENTS 2,162,440 A * 6/1939 Masson ..... B41F 15/423 101/123
2016/0108566 A1* 4/2016 Tseng ..... D04B 1/18 66/196

* cited by examiner

*Primary Examiner* — Amina S Khan
(74) *Attorney, Agent, or Firm* — Alston & Bird LLP

(57) ABSTRACT

A method for creating an image on a fabric includes providing a stretch fabric; stretching the stretched fabric; creating an image on the stretch fabric while the stretch fabric is in a stretched position by imparting a first color to create the image and imparting a second color as a background color, thereby imparting color to inner fibers of the stretch fabric; allowing the stretch fabric to relax; imparting color to only surface fibers of the stretch fabric while the stretch fabric is in the relaxed state; and stretching the stretch fabric to reveal the image, the image created by stretching the stretch fabric such that the inner fibers are visible.

3 Claims, 9 Drawing Sheets

METHOD AND APPARATUS FOR CREATING AN IMAGE ON A FABRIC

BACKGROUND

1. Field of the Invention

The present invention relates generally to fabrics and textiles, and more specifically, to a system and method for creating an image on a fabric, particularly when the fabric is stretched or otherwise shifted.

2. Description of Related Art

Garment and jersey manufactures are always looking for new and exciting ways to improve the look and performance of their products. For instance, compression garments have become very popular. These garments are form fitting and use synthetic fabrics that have elastic properties. These fabrics tend to wick away perspiration and tend to help cool athletes when they are hot and warm them if they are cool. However, advertisements and emblems on these garments tend to be flat, subtle and mundane, which limits the revenue from advertisers and excitement for the fans. Thus, there exists a need for method of creating fabrics that are dynamic and flashy.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

FIG. 13 is a side schematic view of the stretch fabric of FIGS. 11B and 12 in a stretched state showing the inner fibers showing through;

and

Figure 15:
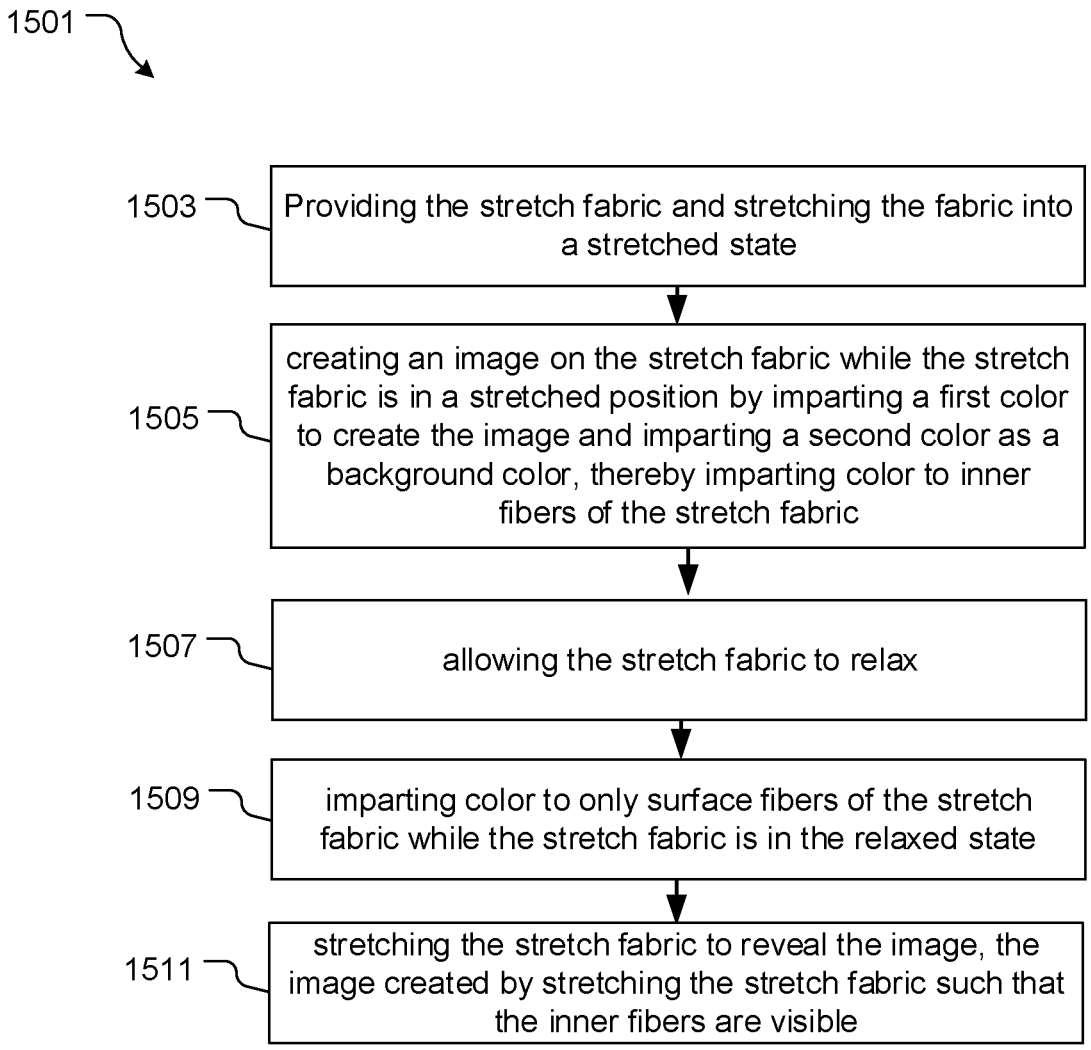

FIG. 15 is a flowchart of the method of creating an image on fabric associated with the alternative embodiment.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 1:
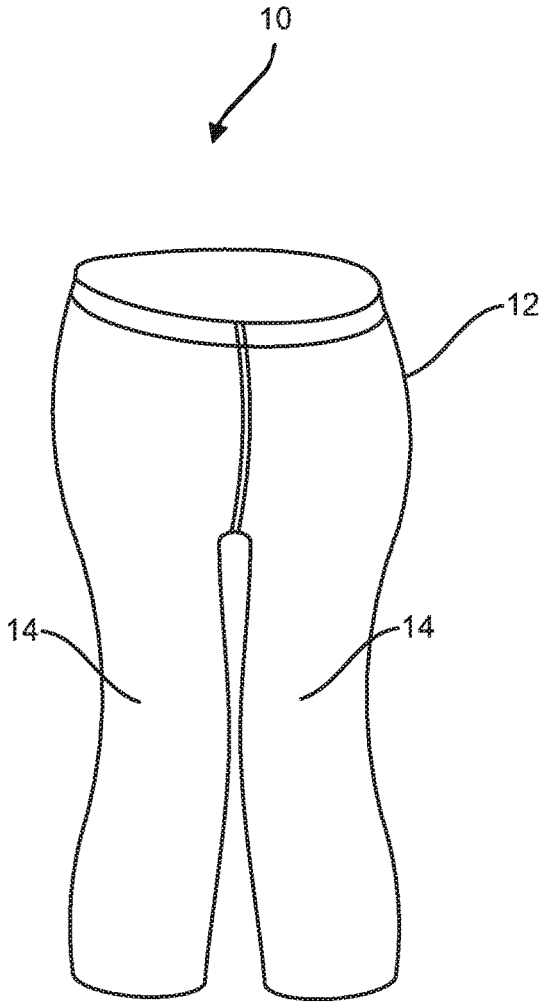
FIG. 1 is a simplified front view of a garment in accordance with one embodiment of the invention.
Figure 2:
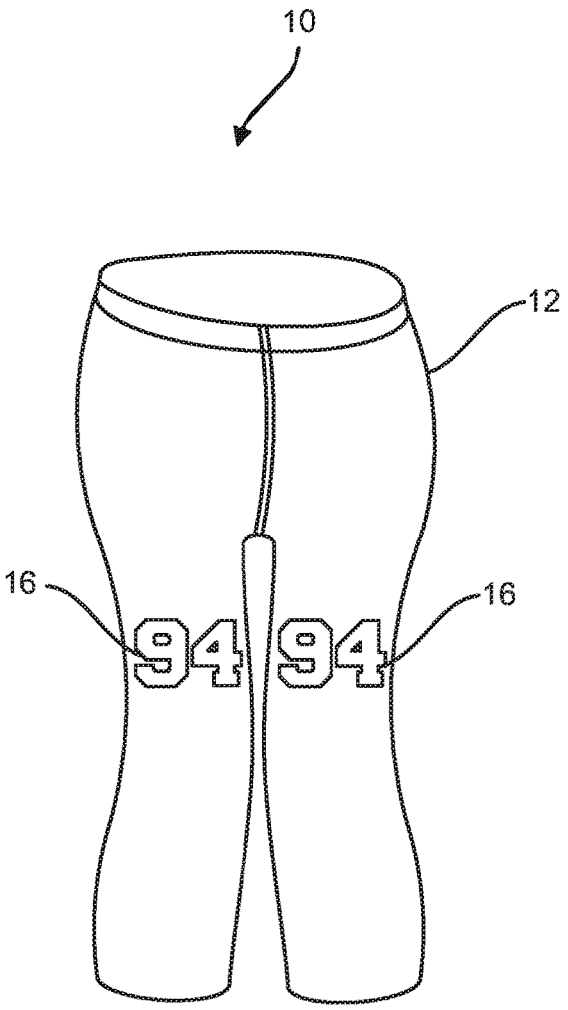
FIG. 2 is a front view of the garment in accordance with one embodiment of the present application.

Referring now to the drawings wherein like reference characters identify corresponding or similar elements throughout the several views. FIG. 1 is a cartoon drawing of a garment 10 in accordance with one embodiment of the invention. In this example the garment is a pair of football pants 12. The pants are either made of stretch fabric or at least the knee portion 14 of the pants 12 are made of stretch fabric with an image created thereon. FIG. 2 is a cartoon drawing of a garment 10 in accordance with one embodiment of the invention. In this figure the fabric in the knee 14 is stretched and the image 16 is now visible. In this case the image is the player's number, but any image can be created. The image is dynamic because it is visible when the fabric is stretched, but not visible when the fabric is in a relaxed state. The size and the brightness of the image varies depending on how much the fabric is stretched, making a flashy image.

Figure 3:
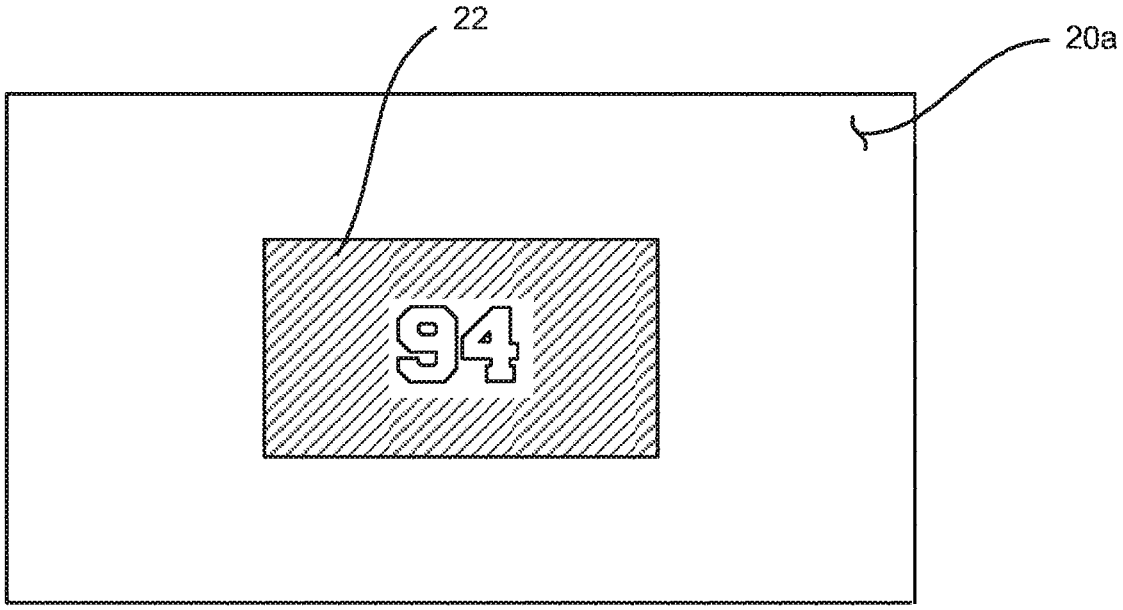
FIG. 3 is a fabric with a first image in accordance with one embodiment of the present invention.

FIG. 3 is a fabric 20*a* with a first image in accordance with one embodiment of the invention. The fabric 20*a* is a stretch fabric that may be a two way or a four way stretch fabric. However, the four way stretch fabric is generally preferred for most applications. For best result, the fabric's original color is very bright, such as a neon color although this will also work on white or light colored fabrics. The fabric 20*a* has a first side 20*a* and a second side 20*b*. In one embodiment, the back side 20*a* is dyed with a knock out image 22 although other images than knock out images may be used. Note the number 94 is not dyed. For best results a sublimation dye process is used to make the image. Sublimation dying may be a direct printing process or may be an indirect process using transfer paper as is well understood in the art.

Figure 4:
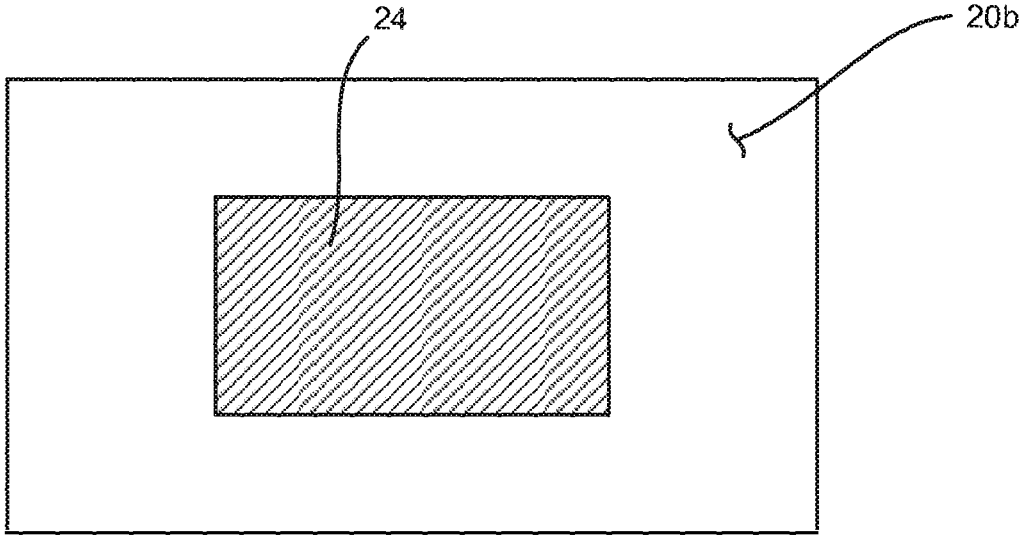
FIG. 4 is a fabric with a second image in accordance with one embodiment of the invention.

FIG. 4 is the fabric 20*b* with a second image 24 in accordance with one embodiment of the invention. The second image is printed on the front side 20*b* of the fabric 20. The dye color is darker than the fabric color and in one embodiment is the same color as the dye used to make the knock out image 22.

In another embodiment, the knock out image 22 is placed on a first fabric 20*a* and the cover 24 is placed on a second fabric 20*b*. The two pieces 20 *a*, 20*b* of fabric are held together so the images overlap with the first fabric 20*a* on the outside. When the fabrics are stretched the knock out image 22 is visible. For the best results the second fabric 20*b* is a light colored fabric.

Note in one embodiment, the image 22 may be something other than a knock out image.

Figure 5:
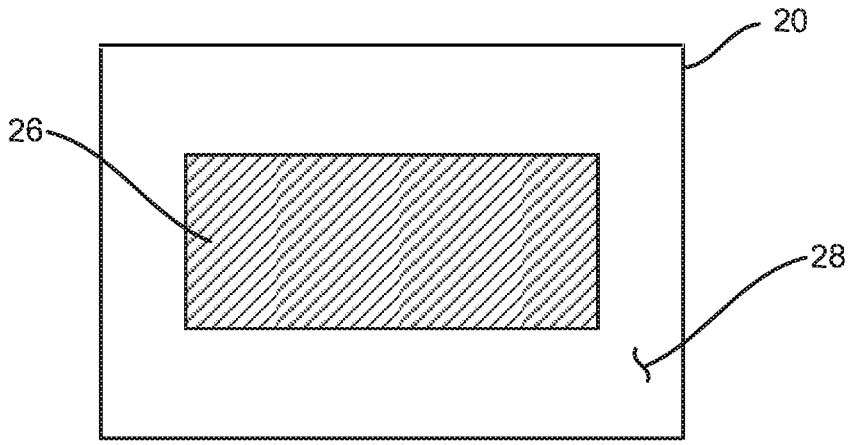
FIG. 5 is a front view of a stretch fabric in a relaxed state in accordance with one embodiment of the invention.
Figure 6:
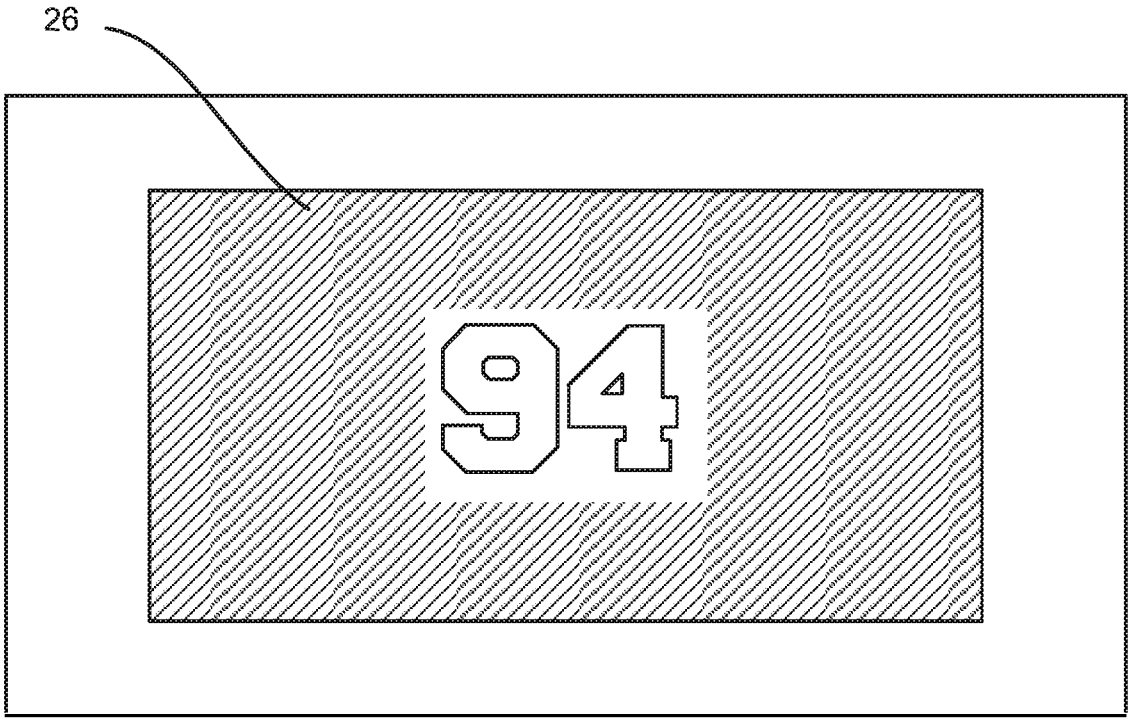
FIG. 6 is a front view of a stretch fabric in a stretched state in accordance with one embodiment of the invention.

FIG. 5 is a front view of a stretch fabric 20 in a relaxed state in accordance with one embodiment of the invention after it has been dyed as explained with respect to FIGS. 3 & 4. The image 26 just looks like a dark square on the fabric 20. Note that the image may be a circle, oval or almost any shape. In one embodiment all of the fabric is dyed so there is no un-dyed portion 28. FIG. 6 is a front view of a stretch fabric in a stretched state in accordance with one embodiment of the invention. Now the image 26 shows the number 94. The number 94 will have the same color (or similar color) as the original fabric.

Figure 7:
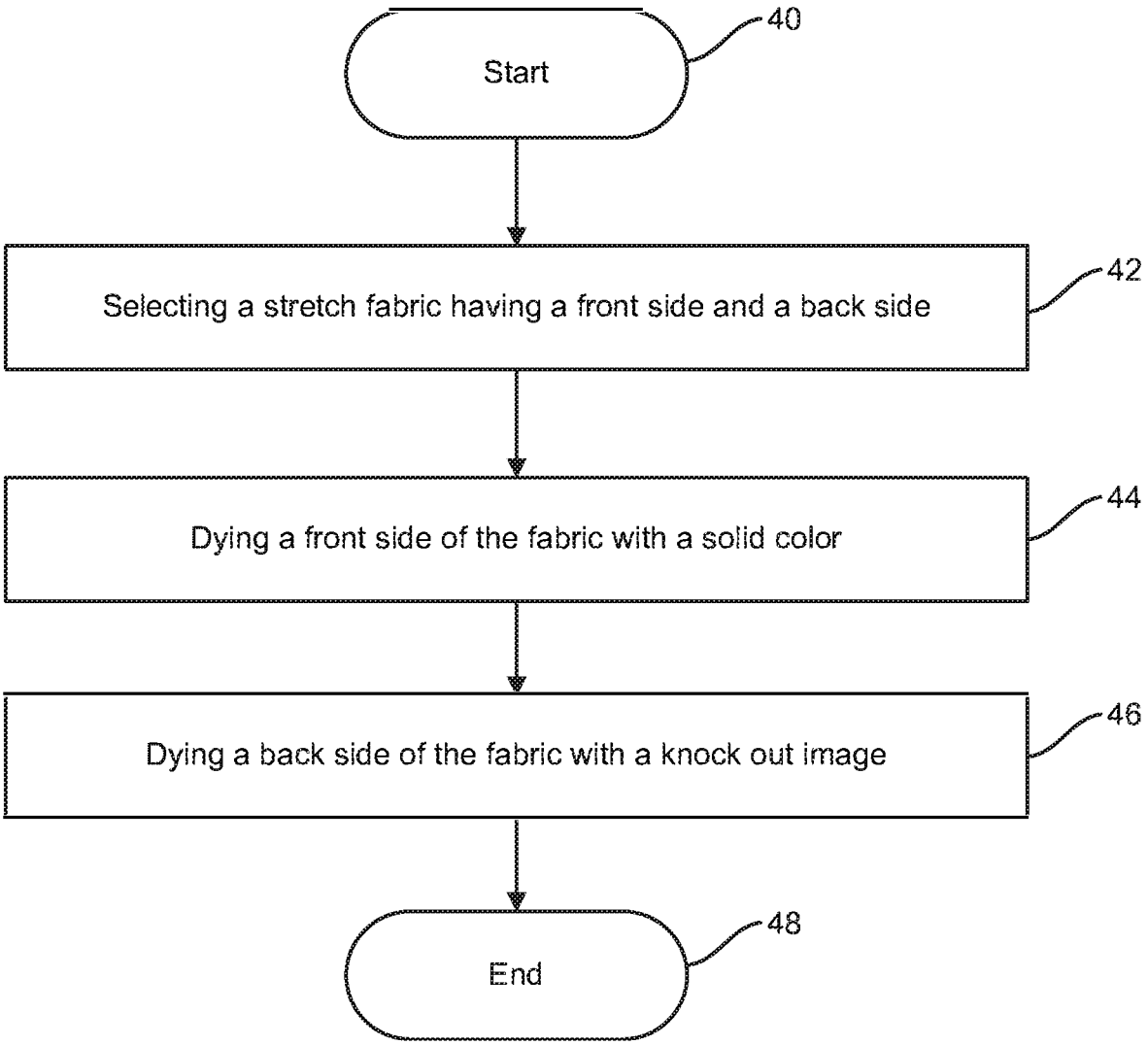
FIG. 7 is a flow chart of the steps used in the method of creating an image on a stretch fabric in accordance with one embodiment of the invention.
Figure 8A:
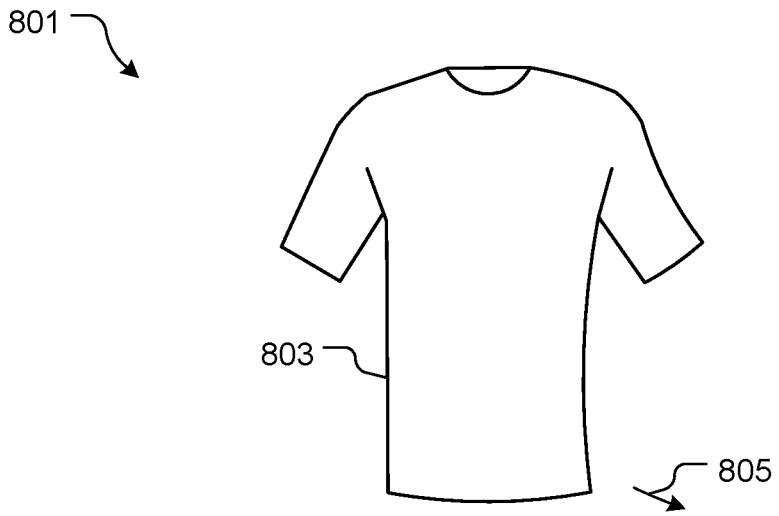
FIGS. 8A and 8B demonstrate a shirt composed wholly or partially of any of the fabrics of the present invention in a relaxed and stretched state.
Figure 8B:
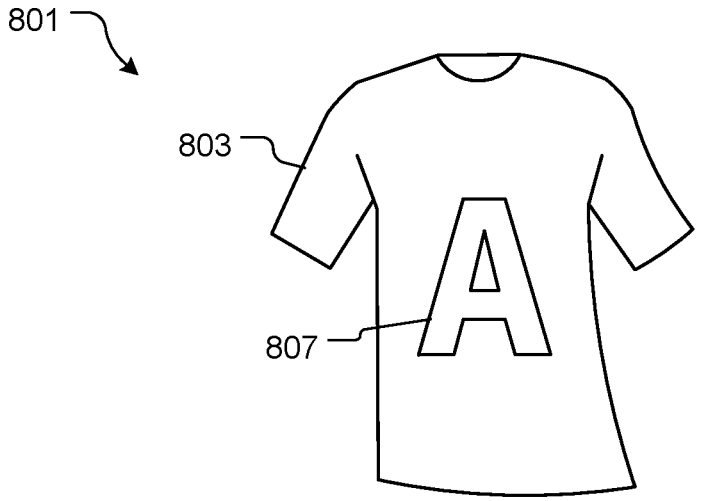

FIG. 7 is a flow chart of the step used in a method of creating an image on a stretch fabric in accordance with one embodiment of the invention. The process starts, step 40, by selecting a stretch fabric have a front side and a back side at step 42. The front side of the fabric is dyed with a solid color at step 44. At step 46, a back side of the fabric is dyed with a knock out image, which ends the process at step 48. The order of when the images are dyed in not important in this embodiment.

Without being held to any particular theory the invention is believed to work because just the surface fibers of the stretch fabric are dyed. When the fabric is stretched part of the fibers are now exposed that were not dyed. Thus, by dying the front and back with a darker color except where the knock out image is results in the only un-dyed fibers are those in the knock out image. Note this effect can also be achieved by first placing the knock out image on the front of the fabric and then dying a filled in image over the top of the knock out image, but it is not the preferred method. If this theory is correct the key points to the invention are just coloring the surface fibers in the relaxed state and coloring them with something that does not inhibit the stretching of the fabric/fibers.

Thus, there has been described a method of creating fabrics that which is dynamic and flashy.

In FIGS. 8-15, an alternative embodiment of an apparatus and method of creating an image on fabric is shown. In FIGS. 8A and 8B, an article of clothing 801 is shown composed in whole or in part of a fabric 803 in accordance with the present invention. As shown, as the fabric 803 is stretched 805, an image 807 is created due to the features discussed herein. It should be appreciated that the fabric need not be stretched a great deal but must be shifted at least slightly to display the image 807. It should be appreciated that the system could also be used to create a second coloration appearance to fabric and/or a pattern associated with the fabric.

Figure 9:
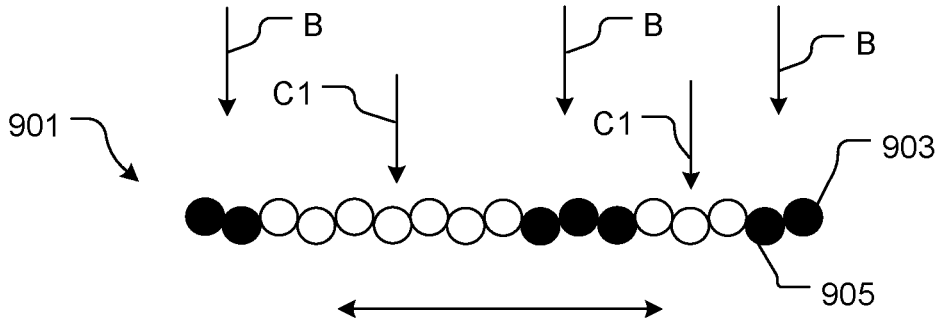
FIG. 9 is a side schematic view of a stretch fabric having at least two layers of fibers in a stretched state.
Figure 10:
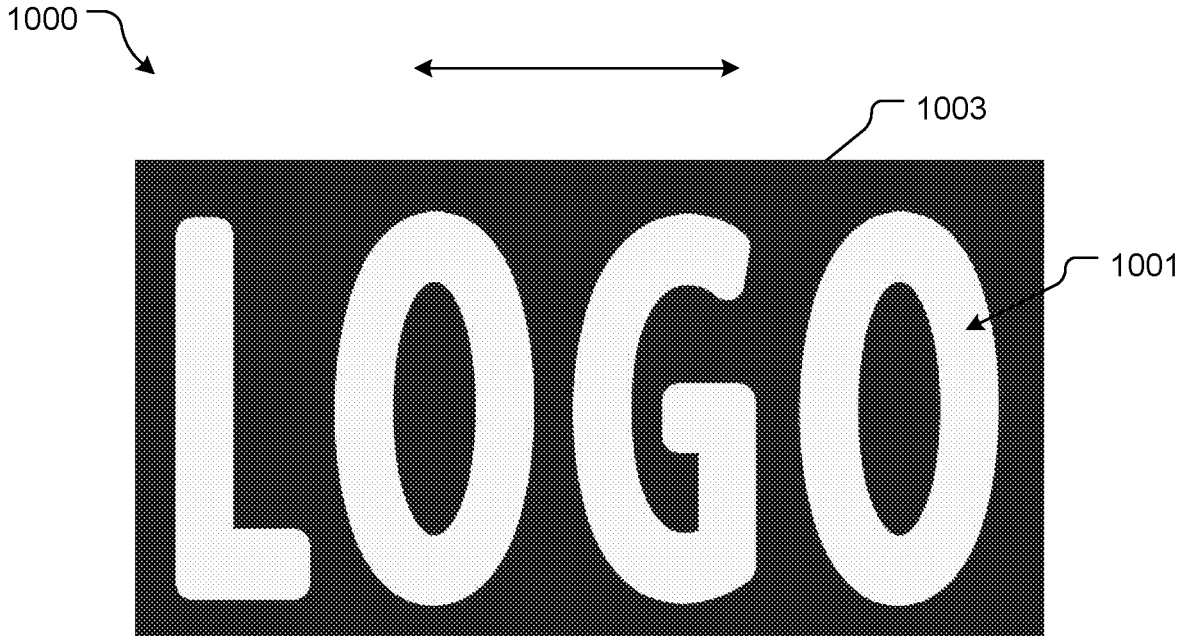
FIG. 10 is an illustration of the stretch fabric of FIG. 9 showing the imparting of an image onto the stretch fabric.

In FIG. 9, a simplified side view depicts a stretch fabric 901 in accordance with an alternative embodiment of the present application. Stretch fabric 901 includes a plurality of layers, including at least surface fibers 903 and an inner fibers 905 as is known in the art. A first treatment consists of stretching the fabric and creating an image. As the fabric is stretched, shown in FIG. 9, the fibers separate, thereby revealing the inner fibers. In this state, a first color (C1) and a background color (B) can be applied to create an image 1001, as shown in FIG. 10. It should be appreciated that the image 1001 can be created through any known means, such as printing or dying, while the fabric is in the stretched state, thereby imparting the first color and background color to both the surface fibers and inner fibers. The result is apparatus 1000 that includes fabric 1003 with image 1001 shown in FIG. 10. It should be appreciated that the fabric shown in FIG. 10 is in a stretched state.

Figure 11A:
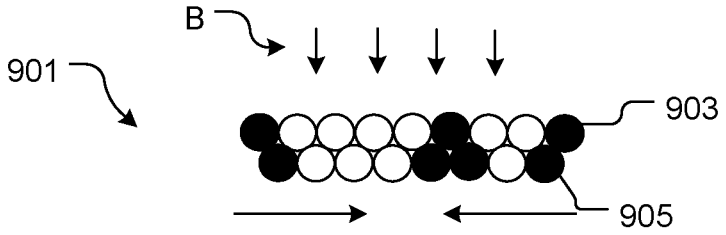
FIG. 11A is side schematic view of the stretch fabric of FIG. 9 in a relaxed state and after the imparting of an image onto the stretch fabric.
Figure 11B:
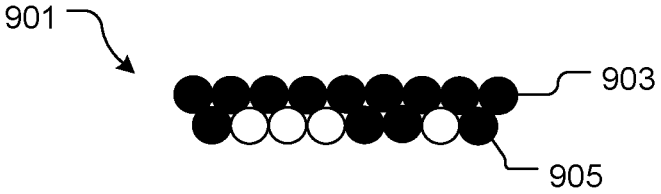
FIG. 11B is a side schematic view of the stretch fabric of FIG. 9 after imparting color to the surface fibers while in a relaxed state.
Figure 12:
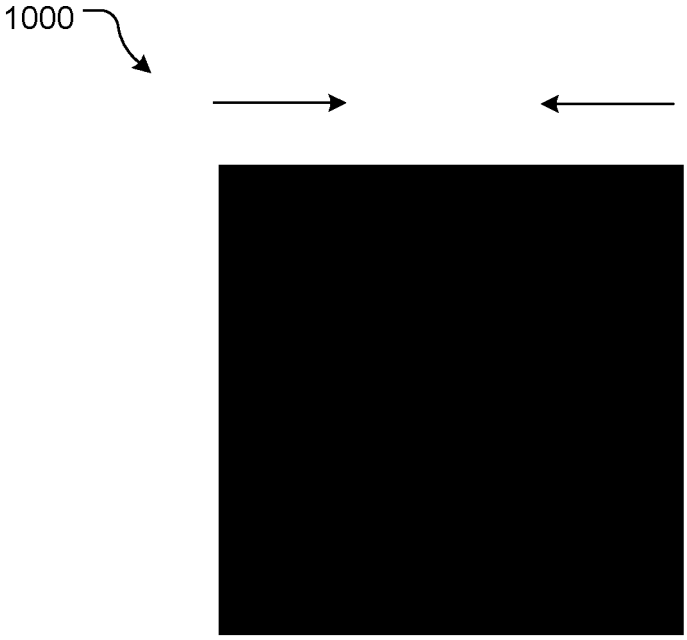
FIG. 12 is an illustration of the stretch fabric of FIG. 11B in a relaxed state.

In FIGS. 11A and 11B, the fabric 901 is shown in a relaxed state, which is the state for a second treatment of the fabric. In FIG. 11A, the fabric 901 is shown before the second treatment, and after the first treatment. In the relaxed state, the background (B) color can be imparted to all the surface fibers 903, thereby resulting in the fiber coloration shown in FIG. 11B, wherein all the surface fibers 903 are the same color, and some of the inner fibers 905 remain the first color. In FIG. 12, the apparatus 1000 is shown after this second treatment, wherein the apparatus 1000 appears a solid color due to the uniform treatment of the surface fibers 903.

Figure 13:
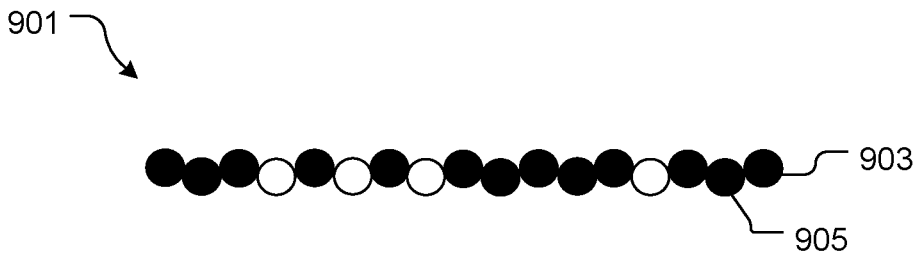
Figure 14:
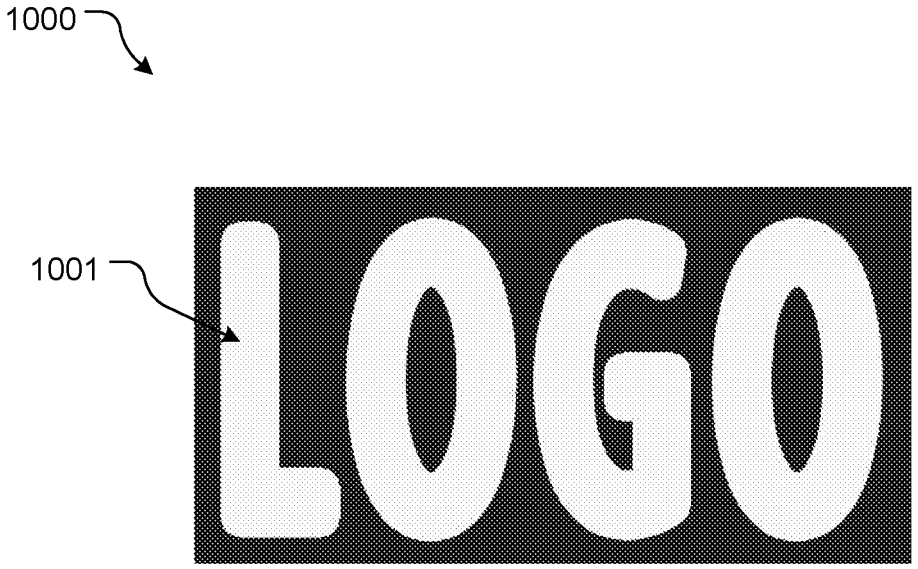
FIG. 14 is an illustration of the stretch fabric of FIG. 13 as the image is displayed.

In FIGS. 13 and 14, the fabric 901 is shown in a stretched state after the first and second treatments discussed above. As shown, now when the fabric is stretched, thereby revealing the inner fibers 905, the inner fibers will show through and depict the image 1001.

It should be appreciated that apparatus 1000 can be incorporated into clothing, such that when the user shifts and moves, the image will show through the plurality of openings.

In FIG. 15, a flowchart depicts the method of creating apparatus 1000. A stretch fabric is provided and stretched into a stretch position for the first treatment, as shown with box 1503. While stretched, an image is created, wherein the image is a first color and the rest of the fabric is a second/background color, as shown with box 1505. The fabric is allowed to relax, wherein color can then be imparted only to the surface fibers, to create a uniform color for the surface fibers, as shown with boxes 1507, 1509. After the surface fibers are colored, such as through dying, the entire surface of the apparatus appears a uniform color. The fabric can then be stretched, revealing the inner fibers along with the image, as shown with box 1511.

It must be appreciated and understood that the image can be a logo, a shape, or the like. Further, it should be appreciated and understood that the teachings of the various embodiments discussed herein can be interchanged based on the desires and needs of the user and manufacturer.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A method for creating an image on a fabric, the method comprising:

providing a stretch fabric;

stretching the stretch fabric;

creating an image on the stretch fabric while the stretch fabric is in a stretched position by imparting a first color to create the image and imparting a second color as a background color, thereby imparting color to inner fibers and surface fibers of the stretch fabric;

allowing the stretch fabric to relax;

imparting color to only surface fibers of the stretch fabric while the stretch fabric is in the relaxed state; and stretching the stretch fabric to reveal the image, the image created by stretching the stretch fabric such that the inner fibers are visible.

2. The method of claim 1, wherein imparting color is through dyeing.

3. The method of claim 1, wherein imparting color is through printing.

* * * * *